United States Patent [19]

Peckinpaugh et al.

[11] 4,277,430

[45] Jul. 7, 1981

[54] QUENCH PROCESS FOR SYNTHETIC FIBERS USING FOG AND FLOWING AIR

[75] Inventors: Frank L. Peckinpaugh; Raymond J. Biron, both of Colonial Heights, Va.

[73] Assignee: Allied Chemical Corporation, Morristown, N.J.

[21] Appl. No.: 100,755

[22] Filed: Dec. 6, 1979

Related U.S. Application Data

[62] Division of Ser. No. 930,119, Aug. 1, 1978, Pat. No. 4,204,828.

[51] Int. Cl.[3] ..... B29H 21/04; B29C 25/00

[52] U.S. Cl. ..... 264/129; 264/176 F; 264/237

[58] Field of Search ..... 264/176 F, 129, 130, 264/237

[56] References Cited

U.S. PATENT DOCUMENTS

| | | | |
|---|---|---|---|
| 3,277,227 | 10/1966 | Kesseler et al. | 264/130 |
| 3,366,721 | 1/1968 | Burdge et al. | 264/130 |
| 4,148,851 | 4/1979 | Tani et al. | 264/130 |

*Primary Examiner*—Jay H. Woo

*Attorney, Agent, or Firm*—R. A. Anderson

[57] ABSTRACT

A quench system for spinning multifilament synthetic fiber using a fog in the quench stack is disclosed. The system and method comprise a. spinning synthetic multifilament fiber from the molten synthetic polymer through a spinnerette into a quench stack, b. quenching the freshly spun fiber in the quench stack with a combination of flowing air and airless atomized water in the form of a fog, and c. taking up the fiber onto a wound package, d. while controlling the air flow, controlling the formation of the fog, and removing any excess water droplets formed in the quench stack.

4 Claims, 1 Drawing Figure

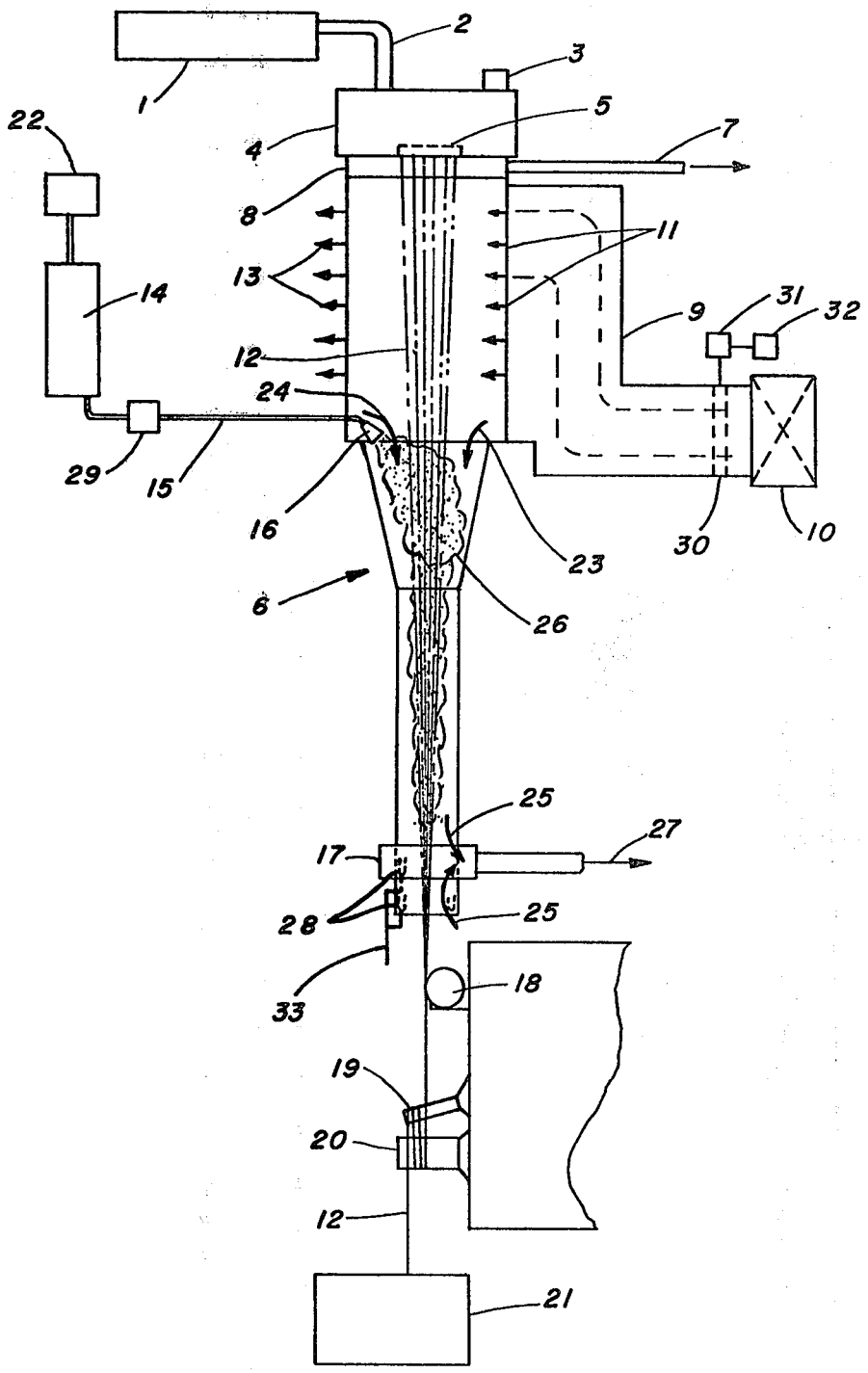
1
2
3
4
5
6
7
8
9
10
11
12
13
14
15
16
17
18
19
20
21
22
23
24
25
26
27
28
29
30
31
32
33

QUENCH PROCESS FOR SYNTHETIC FIBERS USING FOG AND FLOWING AIR

This is a division of application Ser. No. 930,119, filed Aug. 1, 1978, now U.S. Pat. No. 4,204,828.

BACKGROUND OF THE INVENTION

This invention relates to an improved quench system and method for use in spinning multifilament synthetic fiber. More particularly, the system and method use a fog in the quench stack in combination with a flow of air.

By fog is meant fine particles of fluid, such as water suspended in air, specifically excluding fluid such as water droplets not suspended in air. This fog can be mechanically produced with an airless spray nozzle (atomizer) to atomize fluid such as water. Such an airless spray nozzle is disclosed in U.S. Pat. No. 3,366,721 hereby incorporated by reference. By fluid is meant any fluid which can absorb a great deal of heat, such as by the latent heat of vaporization of water or possibly liquid gases. Fluid also means mixtures of water with other fluids beneficial to fibers, such as finishes.

Although it is known to use flowing air to quench freshly spun filaments, and it is known to use airless spray fog or colloidal suspension of fluid, such as water (U.S. Pat. No. 3,366,721) alone to quench filaments, the combination is not taught. Each of these methods when used alone is uneconomical in capital investment or require high flow rates causing filament motion, undesirable for reasons given below.

Because a large volume of air at high velocity is necessary to create the water spray, the prior art method of using flowing air and sprayed water from a compressed air spray nozzle to quench filaments creates great turbulence of the filaments in the quench stack causing at worst filaments fusing together, or at best slight inperfections where the filaments touch or brush one another in the quench stack. Also, turbulence can cause denier variation. These fusions and even denier variation or slight imperfections then cause major problems in subsequent continuous processing of continuous filaments as they break, slough, or wrap on rolls in the drawing, twisting, texturing or like equipment.

Use of steam to condition fiber in the quench stack is also known, but does not utilize the latent heat of vaporization to cool the filaments which is available by use of fog.

Also, use of sprays of water droplets on the yarn is known but cause undesirable non-uniformities along the filament. In fact, such nonuniformity is used to intentionally create weak spots or to create crinkled fiber.

SUMMARY OF THE INVENTION

In the broad concept, the improved method of this invention is to quench freshly spun synthetic multifilament fibers in a quench stack using fog and air compressing spinning synthetic multifilament fiber from its molten polymer through a spinnerette then into a quench stack, introducing flowing air into the quench stack, then introducing fluid, such as water, in the form of fog generated from an airless atomizer into the quench stack along with the flowing air, controlling the air flow, and controlling the formation of the fog, to quench the freshly spun fiber.

A preferred method is to quench freshly spun fibers in a quench stack using air and fog and comprises spinning fiber from its molten polymer through a spinnerette into a quench stack and quenching the freshly spun fiber in the quench stack first with flowing air and then air and fluid, such as water in the form of fog generated from an airless atomizer, and taking up the fiber on a wound package, while controlling the air flow, and controlling the rate of formation of the fog. The atomizer nozzle can be preferably from about 4 to about 8 feet from the spinnerette. Preferably the fibers are from a synthetic polymer. Also, it is preferred to provide one nozzle for each two bundles of multifilament per stack. The air flow is preferably controlled to supply from about 0.01 to 0.15 standard cubic feet per minute per pound polymer per minute and the formation of fog is preferably controlled by atomizing water at a rate of from about 2 ounces of water per minute per pound of polymer per minute to 4.5 ounces of water per minute per pound of polymer per minute at a pressure of about 400 to 720 psi at the nozzle of the atomizer. The nozzle is more preferably located about 6 feet below the spinnerette. By use of this invention, a spinning and quench system designed for high throughput feeder yarn for staple can be converted to produce high quality feeder yarn for continuous filament processing at high throughput rates. The system uses the latent heat of vaporization to obtain a high degree of quenching. The fiber emerging from the interfloor tube has been measured at 20° C. compared to 35° to 40° C. for conventional quench systems.

The quench system of this invention for spinning multifilament fiber, preferably synthetic, using fog and air in a quench stack comprises a spinnerette for spinning synthetic fiber into a quench stack, preferably a cross-flow quench stack, a nozzle for airless atomizing water into fog, the nozzle preferably being located four to eight feet, more preferably, six feet below the spinnerette introducing fog into the quench stack, means for supplying a flow of air to the quench stack, means to exhaust the air flow from the quench stack, means to supply water to the nozzle, means to receive and remove any excess water droplets in the quench stack, means to control the air flow, and means to control the pressure of the water supply to the nozzle. The spinnerette is located at the entrance of the quench stack, while the means for supplying air, means to receive and remove any excess water droplets, means to exhaust air and nozzle all communicate with the quench stack. The means to supply the water communicates with the nozzle. Both the means to control are operatively connected respectively to the air flow supply means and the water supply means. The nozzle atomizes and communicates with the quench stack at a point downstream from said means to supply air and so that no water droplets are formed to directly contact the fiber. The quenching of the fibers is due entirely to the effect of the fog in conjunction with the air flow. Preferably, one nozzle is provided for each two bundles of multifilament fiber per stack. This invention makes possible spinning high quality continuous filament yarn from equipment designed for high throughput staple feeder yarn by simply modifying the quench stack to add the airless atomizer type sprayer to create a fog in the quench stack. This permits a much lower rate of flow of moving air through the quench stack and creates much less filament motion. This reduced filament motion in turn permits practicable downstream continuous processing of the continuous filament yarn because of much fewer feeder yarn fusion points and imperfections where yarn filaments have bounced or contacted one another. Denier quality is also improved. In fact, in a practical application of this invention on a spinning and quench system designed for high throughput staple feeder yarn into a piddler can, it was impossible to take up the yarn from the quench stack onto an acceptable wound package unless the fog was used in conjunction with the flowing air in the quench stack. Without fog introduction into the quench stack, commercially acceptable wound packages were not possible at the high throughputs desired. At those throughputs air flow was so high it caused high filament fusion levels, and very soft, unstable packages that could not be handled normally without sloughs of yarn occurring. Also full size packages could not be wound because ridges, overgrowth and overthrows of yarn would form, causing package deterioration.

Distribution of the quench air in a typical operation is as follows: Fifty percent of the quench air passes across the filaments being quenched and out into the room. The remaining 50 percent is aspirated by the movement of the yarn into the narrow part of the quench stack called the interfloor tube. Of that, 15 percent passes entirely through the tube and exhausts at the lower end of the quench stack and 35 percent is removed by the exhaust system located along the interfloor tube. In other embodiments greater portions of quench air may flow into the room, up to nearly 100 percent.

The new quench system has the upper area (near the spinnerette) operating as a standard cross flow system with a normal air profile, i.e., lower velocity at the top increasing to higher velocity at the bottom. The lower portion acts as a co-current system with room air being introduced in annular manner near the top and being exhausted in an annular manner near the bottom of the interfloor tube. The co-current section has the airless atomizing jet or jets located near the top (below the air introduction point) for the injection of water (or other fluidized medium) under high pressure to form fog. The resulting water as fog and vapor (due to the heat of the polymer filaments vaporizing the suspended fine water particles) are removed from the air exhaust. The use of cooling air prior to contacting filaments with fog puts a tough skin on the filament surface. This avoids the prior art problem of non-uniformities, weak spots, and crinkling of the filaments. Condensation from the cooled interfloor tube is collected at the exit of the tube and drained off to prevent yarn spotting.

This invention offers the following advantages over the prior art:

a. Provides increased heat removal from the fiber during quenching.
b. Combines the best features from both cross flow and co-current flow quench systems.
c. Allows for higher throughputs than either above system is capable of.
d. Reduces amount of fused filaments and filament movement.
e. Increased yarn uniformity.
f. Reduces requirement for high energy consumption of conditioned air.
g. Improved package formation by reducing yarn growth after winding.

BRIEF DESCRIPTION OF THE DRAWING

The FIGURE is a schematic, partial cross section, side view showing a preferred embodiment of the quench system of this invention.

DESCRIPTION OF THE PREFERRED EMBODIMENT

In the FIGURE molten polymer from extruder 1 flows through conduit 2 to be forced by pump 3 through spinnerette 5 in spin block 4. The filaments 12 of synthetic fiber are extruded into quench stack 6 which has monomer exhaust 7 and monomer exhaust ring 8. Cooling air enters through plenum 9 from source of air 10 and enters quench stack as shown by arrows 11 flowing across filaments 12 and out of quench stack 6 as shown by arrows 13. Some quench air is also drawn along with the moving filaments as shown by arrow 23. Room air may also be drawn along in quench stack 6 as shown by arrow 24. Filaments 12 then pass through fog 26 formed by atomizer 16 which receives high pressure water through a pipe 15 from pump 14. Water is supplied from water souce 22. Filaments then pass through the interfloor tube section shown as the narrowed section of quench stack 6. Interfloor tube exhaust 17 for air and water vapor then exhausts a portion of the air drawn along with the filaments through the interfloor tube as shown by arrow 27. Filaments then contact finish roll 18 and pass around and over separator roll 19 and godet roll 20 to be taken up in takeup means 21 which could be a winder or tow can. Droplets of water which may condense inside on quench stack 6 are caught by drip catchers 28. Water is removed through drains 33. Air may flow into interfloor exhaust 17 from either direction as shown by arrows 25.

Control for water pressure to the atomizer is by pressure control valve 29. Control for air flow is by controller 32 on fan motor 31 which powers fan 30.

EXAMPLE

Using the system and method described above, nylon 6 polymer, having properties shown in Table 1, was extruded through a 140 hole ("Y" shaped) spinnerette to a denier of about 6,000, and taken up as two ends of 3,000 denier, 70 filaments each, at a rate of about 76 pounds per hour per spinnerette. Spinning and quench conditions are shown in Tables 2 and 3. The atomizer was a Nordson having the specifications given in Table 4 and atomizing water was done as specified in Table 4. Take-up was by conventional Leesona 967 winders at 3,000 feet/minute using standard spin finish. Air in the takeup area was maintained at about 48% relative humidity and 72° F. The resulting yarn was subsequently drawn, textured, commingled and taken up as a carpet yarn sales package. The yarn had properties as shown in Table 5. Yarn was then made into small carpet samples equal in appearance and quality to presently commercial carpet.

Note the air flow rate is about one third of normal for preparation of nylon feeder yarn for making nylon staple yarn for carpet end use. Also, the comparative data in Table 3 show the fusion of filaments is improved by 800% by using fog in combination with flowing air.

TABLE 1

| Properties of Nylon 6 Polymer | Type 1 | Type 2 |
|---|---|---|
| Relative Viscosity | 56 | 60 |
| Extractables, % | 2.7 | 2.0 |
| Carboxyl ends, per milliequivalents of polymer | 7.5 | 12 to 16 |
| Amine ends, per | 47 | 72 |

TABLE 1-continued

| Properties of Nylon 6 Polymer | Type 1 | Type 2 |
|---|---|---|
| milliequivalents of polymer | | |

TABLE 2

| Spinning Conditions | |
|---|---|
| Extruder temperature | 260° C. |
| Extruder pressure | 600 psig |
| Pump type | 5.6 cc/rev. |
| Pump rpm | 55.2 |
| Block temperature | 260° C. |
| Exit polymer temperature | 263° C. |
| Filter pack type | Screens |

TABLE 3

| Quench Conditions Cross Flow Quench | |
|---|---|
| Quench Air | |
| Temperature, °F. | 65 |
| Relative Humidity, % | 65 |
| Air flow, cfm | 400 |
| Velocity | 60 fpm avg. |
| Monomer exhaust, vacuum | |
| Inches of water | 2 to 4 |
| Fused filaments, % | .007 |
| Comparative Data | |
| Fused filaments, with water to atomizer off | .056 |

TABLE 4

| Atomizer Specifications | |
|---|---|
| Type | Nordson, 16:1 drive pressure to output pressure ratio |
| Orifice, inches | .003 |
| Turbulence plate, inches | .003 |
| Pressure, psig. | 560 |
| Water flow, ounces per minute per nozzle | 3.84 |

TABLE 5

| Yarn Properties | Type 1 | Type 2 |
|---|---|---|
| Undrawn | | |
| Denier | 3,000 | 3,120 |
| Ultimate Elongation, % | 315 | 360 |
| Tenacity, grams/denier | 1.1 | 1.7 |
| Drawn | | |
| Draw Ratio | 2.8 | 3.0 |
| Drawing Speed,fpm | 5,000 | 6,000 |
| Denier | 1,330 | 1,300 |
| Ultimate Elongation, % | 53 | 52 |
| Tenacity, grams/denier | 2.1 | 3.0 |
| Entanglements per meter | 33 | 31 |
| Yarn breaks during drawing, per hour | .63 | 1.0 |
| Yield of yarn on packages versus yarn from spinning, % | 86.5 | — |

INITIAL TRIALS

In initial trials of the use of fog in the quench stack combined with flowing air, a closed quench stack using co-current air flow was used. Several times, when operating the spinning and quenching at 45 pounds/hour of polymer throughput and otherwise standard conditions, as given above, cylindrical packages of nylon 6 yarn could not be taken up on conventional winders when the fog was not being introduced about 6 feet down the stack because the yarn being wound would expand and form ridges and slough off of the packages until winding failed. Introducing fog under the same conditions permitted normal winding of full size yarn packages. Increasing air flow without fog would have created much undesirable filament motion in the quench stack. Also, yarn produced with no fog as compared to yarn produced with fog introduced to the quench stack along with the flow of air was highly inferior in mechanical quality during subsequent processing. That is, the yarn produced with no fog had a great deal more imperfections and nonuniformities along the length of the filaments as shown by problems in drawing. One sample of yarn produced with fog had no wraps during subsequent drawing while an equal amount taken from partial packages of yarn quenched with no fog had 0.21 wraps per pound of yarn drawn. One sample produced without fog could not be drawn because it continually broke when drawn at the same conditions as yarn quenched with fog and flowing air.

Using ten samples of wound sales packages of each type of nylon 6 feeder yarn for carpet end-use, one set quenched with air only and the other set quenched with air and fog under otherwise identical conditions, a comparative evaluation of mechanical quality was made. The packages were evaluated objectively, visually. A value of 1 indicates no overthrown ends, no broken fils and no loops on the package. The inspectors were trained in ordinary daily quality control inspections. The standard for commercial yarn is 2. A value of 5 indicates very poor quality, and any value above 3.5 would be rejected and not sold. The trial average for packages of yarn produced with fog in the quench stack was 1.8. The trial average for packages of yarn produced without fog in the quench stack was 4.4. The yarn produced without fog made unacceptable packages and also would not pass through the standard tufting needles used to tuft carpet due to snags from yarn imperfections.

We claim:

1. A method to quench freshly spun synthetic multifilament fibers in a quench stack using fog and air comprising spinning synthetic multifilament fiber from its molten synthetic polymer through a spinnerette into a quench stack, quenching the freshly spun fiber in the quench stack first with flowing air and then with a combination of flowing air and water in the form of a fog generated from an airless atomizer, and taking up said fiber onto a wound package, while controlling said air flow, and controlling the rate of formation of said fog, providing one nozzle for each two bundles of multifilament fiber per stack, controlling said air flow to a supply of from about 0.01 to 0.15 scfm per pound of polymer per minute, controlling said formation of fog by atomizing water at a rate of from 2 ounces of water per minute per pound of polymer per minute to about 4.5 ounces of water per minute per pound of polymer per minute at a pressure of about 400 to 720 at the nozzle of said atomizer, locating said nozzle at about 6 feet below said spinnerette, so that a spinning and quench system designed for high throughput feeder yarn for staple can produce high quality feeder yarn for continuous filament processing.

2. A method to quench freshly spun fibers in a quench stack using fog and air comprising spinning fiber from its molten polymer through a spinnerette into a quench stack, and quenching the freshly spun fiber in the quench stack first with flowing air then a combination of flowing air and water in the form of fog generated from an airless atomizer, and taking up said fiber onto a wound package, while controlling said air flow, and controlling the rate of formation of said fog.

3. The method of claim 2 wherein said polymer is synthetic and said atomizer nozzle is from about 4 to about 8 feet from said spinnerette.

4. A method to quench freshly spun synthetic multifilament fibers in a quench stack using fog and air comprising spinning synthetic multifilament fiber from its molten polymer through a spinnerette into a quench stack first introducing flowing air into said quench stack, then introducing fluid in the form of a fog generated from an airless atomizer into said quench stack, controlling said air flow, and controlling said formation of said fog, to quench the freshly spun fiber.

* * * * *